US009128411B2

(12) United States Patent
Nakamura et al.

(10) Patent No.: US 9,128,411 B2
(45) Date of Patent: Sep. 8, 2015

(54) DEVELOPING DEVICE, PROCESS CARTRIDGE, AND ELECTROPHOTOGRAPHIC APPARATUS

(71) Applicant: CANON KABUSHIKI KAISHA, Tokyo (JP)

(72) Inventors: Minoru Nakamura, Mishima (JP); Takuya Kitamura, Yokohama (JP); Kouki Yano, Kawasaki (JP); Yuji Kawaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/290,756

(22) Filed: May 29, 2014

(65) Prior Publication Data

US 2015/0003862 A1 Jan. 1, 2015

(30) Foreign Application Priority Data

Jun. 27, 2013 (JP) ..... 2013-135659

(51) Int. Cl.
*G03G 15/08* (2006.01)

(52) U.S. Cl.
CPC ..... *G03G 15/0812* (2013.01); *G03G 15/08* (2013.01); *G03G 15/081* (2013.01); *G03G 15/0813* (2013.01); *G03G 15/0818* (2013.01)

(58) Field of Classification Search
CPC ..... G03G 15/0812; G03G 15/0818; G03G 15/081; G03G 15/0813; G03G 15/08
See application file for complete search history.

(56) References Cited

U.S. PATENT DOCUMENTS

| | | | | |
|---|---|---|---|---|
| 5,177,537 | A | 1/1993 | Okano et al. | |
| 2004/0223789 | A1* | 11/2004 | Inami et al. | 399/252 |
| 2010/0054804 | A1* | 3/2010 | Uneme et al. | 399/119 |
| 2013/0028634 | A1 | 1/2013 | Koyanagi et al. | |
| 2014/0205338 | A1* | 7/2014 | Gondoh et al. | 399/350 |

FOREIGN PATENT DOCUMENTS

| | | | |
|---|---|---|---|
| EP | 2 071 412 | A1 | 6/2009 |
| JP | 08-227212 | A | 9/1996 |
| JP | 2007-033538 | A | 2/2007 |
| JP | 2007-233255 | A | 9/2007 |
| JP | 2009-116009 | A | 5/2009 |

OTHER PUBLICATIONS

Machine translation of reference Kurachi et al. (JP 2012-037,644 A), Pub Date Feb. 23, 2012.*
Machine translation of Abstract of reference Kurachi et al. (JP 2012-037,644 A), Pub Date Feb. 23, 2012.*
EESR, Jan. 12, 2014, Application No./Patent No.: EP14001892.0-1303, Pub date Jan. 12, 2014.

* cited by examiner

*Primary Examiner* — Rodney Bonnette
(74) *Attorney, Agent, or Firm* — Canon U.S.A., Inc. IP Division

(57) ABSTRACT

A developing device includes a developing chamber provided with a developing roller that conveys toner to a developing area, and a toner regulating member that is in contact with a surface of the developing roller; and a toner container that contains the toner. An opening that allows the developing chamber and the toner container to communicate with each other is closed by a seal member that prevents the toner in the toner container from flowing into the developing chamber, and the seal member is removable from the opening. Spherical resin particles are provided at least in a contact portion between the developing roller and the toner regulating member. A Martens hardness of the spherical resin particles is 0.5 N/mm$^2$ or higher and 45 N/mm$^2$ or lower, and a restoring elastic power of the spherical resin particles is 70% or higher.

7 Claims, 3 Drawing Sheets

DEVELOPING DEVICE, PROCESS CARTRIDGE, AND ELECTROPHOTOGRAPHIC APPARATUS

BACKGROUND OF THE INVENTION

1. Field of the Invention

The present invention relates to a developing device, a process cartridge, and an electrophotographic apparatus.

2. Description of the Related Art

In an electrophotographic apparatus such as a copier, a printer, and a receiver of a facsimile, a rotating image carrying member is uniformly charged by a charging member, and laser light is applied to the charged image carrying member, whereby an electrostatic latent image is formed. Then, toner is supplied to the electrostatic latent image by a developing device, whereby the electrostatic latent image is developed into a toner image. Subsequently, the toner image is transferred from the image carrying member to a transfer material (a recording material), and the toner image on the transfer material is fixed by heating or the like. Thus, the transfer material has an image. Meanwhile, the static electricity on the surface of the image carrying member that has undergone the transfer of the toner image is eliminated, and residual toner is removed from the surface of the image carrying member. Thus, the electrophotographic apparatus is ready for forming another image.

The developing device includes a developing chamber and a toner container that contains toner. The developing chamber is provided with a developing roller, a toner supplying member that supplies toner to the surface of the developing roller, and so forth. The developing chamber is further provided with a toner regulating member that regulates the toner supplied to the surface of the developing roller by the toner supplying member into a thin layer having a more uniform thickness. With the rotation of the developing roller, the thin layer of toner is conveyed to the outside of the developing device. The thin layer of toner then adheres to the electrostatic latent image on the rotating image carrying member that is provided against a portion of the developing roller that is exposed to the outside of the developing device, whereby the electrostatic latent image is visualized. Thus, a toner image is formed on the image carrying member.

Before the developing device starts to be used, toner remains contained in the toner container. When the developing device starts to be used, the toner starts to be fed into the developing chamber. Hence, before the developing device starts to be used, the developing roller is directly in contact with the toner regulating member and the toner supplying member.

Japanese Patent Laid-Open No. 8-227212 addresses problems such as damage to a toner supplying member attributed to the direct contact between a developing sleeve and the toner supplying member in a developing device that is yet to be used. According to Japanese Patent Laid-Open No. 8-227212, such a problem is solved by employing a toner supplying member having cells on its outermost layer and by providing powder having specific chargeability at least on the surface of the toner supplying member.

According to Japanese Patent Laid-Open No. 2007-33538, the above problem is solved by providing powder whose glass transition temperature is 80° C. or higher at least on the surface of a toner supplying member.

However, according to a review of the developing device disclosed by Japanese Patent Laid-Open No. 2007-33538 that has been conducted by the present inventors, if the developing device that is yet to be used is vibrated or something during transportation, resulting electrophotographic images may have nonuniformity in the form of stripes in a portion thereof corresponding to a portion of the surface of the developing roller that is in contact with the toner regulating member. Hereinafter, the nonuniformity in the form of stripes that may appear in an electrophotographic image is also referred to as "banding." The banding tends to be particularly pronounced in a halftone image. This is probably because of some change that occurs in the portion of the surface of the developing roller that is in contact with the toner regulating member.

Such a change in the surface of the developing roller that affects the quality of resulting electrophotographic images is occasionally referred to as "electrostatic memory." A phenomenon of the appearance of such an "electrostatic memory" is occasionally referred to as "generation of an electrostatic memory."

Accordingly, the present invention is directed to providing a developing device in which an electrostatic memory that may cause banding in electrophotographic images does not tend to be generated on a developing roller even if the developing device that is yet to be used is vibrated during long-time transportation.

The present invention is also directed to providing an electrophotographic apparatus that is capable of stably outputting high-quality electrophotographic images.

SUMMARY OF THE INVENTION

According to a first aspect of the present invention, there is provided a developing device comprising: a developing chamber provided with a developing roller that conveys toner to a developing area, and a toner regulating member that is in contact with a surface of the developing roller; and a toner container that contains the toner. An opening that allows the developing chamber and the toner container to communicate with each other is closed by a seal member that prevents the toner in the toner container from flowing into the developing chamber, and the seal member is removable from the opening. Spherical resin particles are provided at least in a contact portion between the developing roller and the toner regulating member. A Martens hardness of the spherical resin particles is 0.5 $N/mm^2$ or higher and 45 $N/mm^2$ or lower, and a restoring elastic power of the spherical resin particles is 70% or higher.

According to a second aspect of the present invention, there is provided a process cartridge that is attachable to and detachable from a body of an electrophotographic apparatus. The process cartridge includes an image carrying member that carries an electrostatic latent image, and a developing device that forms a toner image by developing the electrostatic latent image with toner. The developing device is the developing device according to the first aspect of the present invention.

According to a third aspect of the present invention, there is provided an electrophotographic apparatus including an image carrying member that carries an electrostatic latent image, a charging device that performs primary charging on the image carrying member, an exposure device that forms the electrostatic latent image on the image carrying member that has undergone primary charging, a developing device that forms a toner image by developing the electrostatic latent image with toner, and a transfer device that transfers the toner image to a transfer material. The developing device is the developing device according to the first aspect of the present invention.

According to a fourth aspect of the present invention, there is provided a developing device comprising: a developing chamber provided with a developing roller that conveys toner to a developing area, and a toner regulating member that is in contact with a surface of the developing roller; and a toner container that contains the toner. Spherical resin particles are provided at least in a contact portion between the developing roller and the toner regulating member. A Martens hardness of the spherical resin particles is 0.5 $N/mm^2$ or higher and 45 $N/mm^2$ or lower, and a restoring elastic power of the spherical resin particles is 70% or higher.

Further features of the present invention will become apparent from the following description of exemplary embodiments with reference to the attached drawings.

DESCRIPTION OF THE EMBODIMENTS

Figure 1:
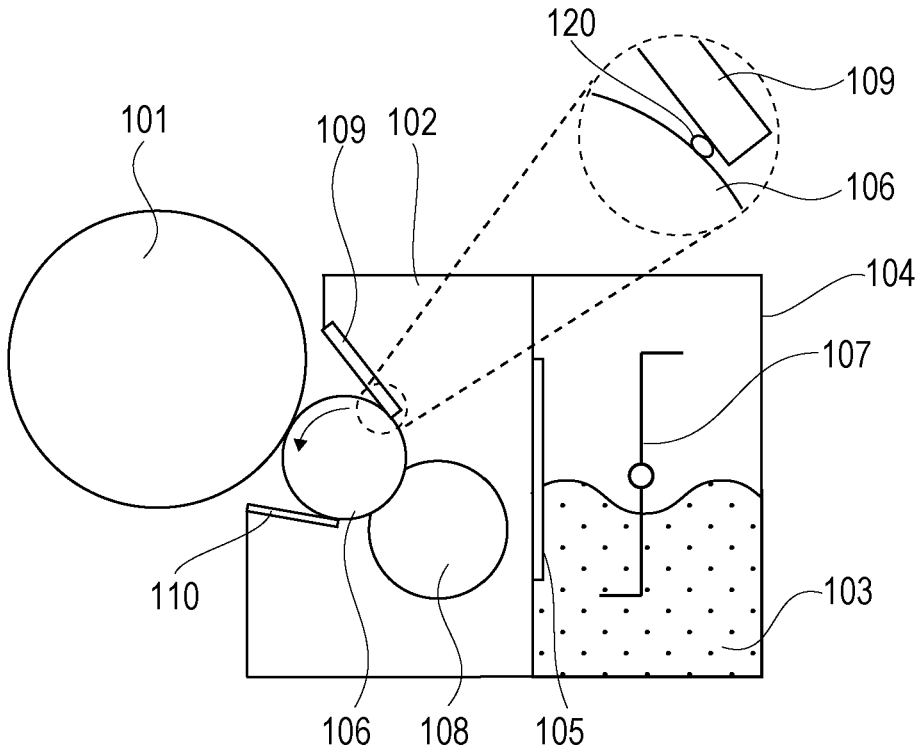
FIG. 1 is a schematic sectional view of a developing device according to a first exemplary embodiment of the present invention.

The present inventors have thoroughly reviewed the developing device disclosed by Japanese Patent Laid-Open No. 2007-33538, focusing on an electrostatic memory attributed to vibration continuing for a long time, and have found three possible major causes of such an electrostatic memory.

First, particles that are present in a contact portion between the developing roller and the toner regulating member undergo significant permanent deformation by being pressed between the two, allowing the developing roller and the toner regulating member to come into direct contact with each other. If the developing roller and the toner regulating member in such a state vibrate in a thrust direction, an electrostatic memory may be generated. Such an electrostatic memory generated by the sliding of the developing roller and the toner regulating member along each other in the thrust direction is occasionally referred to as "thrust memory."

Second, it has been found that an uneven distribution of the powder on the surface of the developing roller or the toner regulating member may also generate a thrust memory. More specifically, the powder is initially distributed evenly in the contact portion between the developing roller and the toner regulating member. However, as the developing device is vibrated repeatedly, some particles of the powder may gather, resulting in an uneven distribution of the powder. Consequently, the developing roller and the toner regulating member come into direct contact with each other in some portions, where a thrust memory may be generated.

Third, the generation of an electrostatic memory may be attributed to some physical stress applied to the developing roller and the toner regulating member from particles that are present in the contact portion between the two. Although details of such a mechanism are unknown, the present inventors presume that a physical stress that is applied over a long time may cause slight nonuniformity in the electric resistance or some other phenomenon on the surface of the developing roller.

If particles that do not undergo permanent deformation are provided between the developing roller and the toner regulating member, a certain level of advantageous effect is produced in terms of reduction in the occurrence of a thrust memory. However, if the particles have a high degree of hardness, an electrostatic memory may be generated by some physical stress applied to the developing roller.

Accordingly, the present inventors have considered that the above problem would be solved if particles provided between the developing roller and the toner regulating member show the following behaviour.

In case that vibration occurs, the particles absorb the impact of the vibration by undergoing deformation; if the vibration thus subsides, the deformed particles quickly restore their original shapes; and if any vibration occurs again, the particles undergo deformation again and thus absorb the impact of the vibration.

Hence, the present inventors have made another review, focusing on the hardness and the restoring elastic power of particles having spherical shapes.

In the review, it has been found that the problem attributed to a thrust memory does not occur if particles are characterized in having a flexible degree of hardness that falls within a specific range, having a high restoring elastic power of a specific level or higher, and having a spherical shape. Such particles can roll (turn over) while they are deformed into oval shapes between the developing roller and the toner regulating member. Therefore, no physical stress is applied to specific portions of the two members. Thus, the generation of a thrust memory is suppressed. Furthermore, the particles quickly restore their original spherical shapes. Therefore, the uneven distribution of particles attributed to repeated vibrations does not tend to occur, suppressing the direct contact between the developing roller and the toner regulating member. Thus, the generation of a thrust memory is suppressed.

(Spherical Resin Particles)

In a developing device according to a general embodiment of the present invention, spherical resin particles are provided at least in a contact portion between a developing roller and a toner regulating member. Additionally, the Martens hardness of the spherical resin particles is 0.5 $N/mm^2$ or higher and 45 $N/mm^2$ or lower, and the restoring elastic power of the spherical resin particles is 70% or higher.

The Martens hardness of the spherical resin particles are within the range of 0.5 $N/mm^2$ or higher and 45 $N/mm^2$ or lower so that the physical stress that may be applied to the developing roller is reduced as much as possible.

If the Martens hardness is higher than 45 $N/mm^2$, a thrust memory attributed to a large physical stress to the developing roller may be generated. If the Martens hardness is smaller than 0.5 $N/mm^2$, an effect of suppressing the generation of a thrust memory is produced. However, the spherical resin particles become very sticky and may, for example, stick to associated members.

If the spherical resin particles undergo permanent deformation, the distribution of the spherical resin particles between the developing roller and the toner regulating member may become uneven with repeated vibrations, making it difficult to suppress the generation of a thrust memory. Therefore, the restoring elastic power of the spherical resin particles is set to 70% or higher.

In terms of satisfactorily meeting the above conditions, the base material of the spherical resin particles may be urethane resin or silicone resin.

Furthermore, the spherical resin particles according to the general embodiment of the present invention may have an average circularity of 0.96 or higher. If the spherical resin particles have an average circularity of 0.96 or higher, the probability that the spherical resin particles are prevented from rolling is low, which is considered to be especially effective for suppressing the generation of a thrust memory.

The weight-average particle size of the spherical resin particles may be 1 μm or larger and 50 μm or smaller.

<Method of Measuring Martens Hardness and Restoring Elastic Power of Spherical Resin Particles>

The Martens hardness and the restoring elastic power of the spherical resin particles are measured by using a microhardness measuring instrument (PICODENTOR (a registered trademark) HM500 manufactured by Fischer Instruments K.K.) with a regular-pyramid diamond indenter (Vickers indenter) whose angle between opposite faces is 136°.

The measurement includes a step of pressing the indenter into a particle with a predetermined load (the step is hereinafter referred to as indenting step), and a step of removing the predetermined load (the step is hereinafter referred to as unloading step).

A load displacement curve obtained in the measurement is evaluated by using exclusive measurement software "WIN-HCU (a registered trademark)." Thus, the Martens hardness ($N/mm^2$) and the restoring elastic power (We/Wt×100, where We denotes the restoring workload of elastic deformation caused by indentation, and Wt denotes the total workload of mechanical indentation) are obtained.

A specific measurement procedure is as follows. Spherical resin particles are provided on a slide glass (manufactured by AS ONE Corporation) with a cotton swab, excessive spherical resin particles are blown off with air, and the remaining spherical resin particles are measured. The spherical resin particles to be measured are selected from those each having a size that is as approximate as possible to the below-described weight-average particle size (D4).

Since the measurement stage has a resolution of 1 μm, it is difficult to press the tip of the indenter into the center of a small spherical resin particle having a size of about 10 μm. Therefore, the indenter may be pressed into a sloping portion of the spherical resin particle, failing in correct measurement. Moreover, if the centroid of the spherical resin particle is changed, the spherical resin particle may be displaced during the measurement, failing in correct measurement. To avoid such phenomena, after the indenter is pressed into a spherical resin particle, the stage is moved to a microscope and whether or not the spherical resin particle is displaced from the position taken before the indentation with the indenter is checked.

If the spherical resin particle into which the indenter has been pressed is not displaced by 1 μm or more from the position taken before the indentation with the indenter, the tip of the indenter is regarded as being in contact with the center of the spherical resin particle. In such a case, data obtained in the measurement is regarded as being correct and effective and is used for the calculations of the Martens hardness and the restoring elastic power.

In contrast, if the spherical resin particle into which the indenter has been pressed is displaced by 1 μm or more from the position taken before the indentation with the indenter or if the spherical resin particle has disappeared from the slide glass (because, for example, the spherical resin particle has adhered to the indenter), data obtained in the measurement is not regarded as being correct, that is, the data is regarded as being ineffective, and is not used for the calculations of the Martens hardness and the restoring elastic power.

To correct the position of the displaced indenter, the indenter may be adjusted for each measurement. Furthermore, the indenter may be cleaned with ethanol for each measurement.

Measurement conditions for the indenting step and the unloading step are set as follows.

Indenting step: An indenting load is applied to the spherical resin particle for an indenting time of 20 seconds while the indenting load is increased from 0 mN to 0.1 mN with a constant increment per unit time.

Unloading step: The indenting load on the spherical resin particle is reduced over an unloading time of 20 seconds from 0.1 mN to 0 mN with a constant decrement per unit time.

Among 20 pieces of effective data obtained in the above manner, the average of 18 pieces of effective data, which are those excluding the maximum value and the minimum value, is calculated and taken as the Martens hardness and the restoring elastic power of the spherical resin particles according to the general embodiment of the present invention.

<Method of Measuring Average Circularity of Spherical Resin Particles>

The average circularity of the spherical resin particles is measured by using a flow-type particle image analyzer "FPIA-3000" (manufactured by Sysmex Corporation) under measurement and analysis conditions set forth at the time of calibration work.

Specifically, about 20 ml of ion-exchanged water from which impure solid matter and the like have been removed in advance is poured into a glass container. About 0.2 ml of a diluted solution obtained by diluting a dispersant (Contaminon (a registered trademark) N manufactured by Wako Pure Chemical Industries, Ltd., an aqueous solution containing a 10%-by-mass pH-7 neutral detergent for cleaning precision measuring instruments, the detergent being composed of a nonionic surfactant, an anionic surfactant, and an organic builder) with ion-exchanged water to about three times by mass is added to the ion-exchanged water in the container.

Furthermore, about 0.02 g of spherical resin particles as measurement samples are added, and the resultant is dispersed for two minutes by using an ultrasonic dispersion device. Thus, a dispersion liquid for measurement is obtained. In this procedure, the dispersion liquid is cooled according to need to a temperature of 10° C. or higher and 40° C. or lower. The ultrasonic dispersion device is a desktop ultrasonic cleaning/dispersion device having an oscillation frequency of 50 kHz and an electrical output of 150 W (for example, "VS-150" manufactured by VELVO-CLEAR). A predetermined amount of ion-exchanged water is poured into a bath of the ultrasonic dispersion device, and about 2 ml of Contaminon N is added thereto.

The measurement is conducted by using the flow-type particle image analyzer including a standard objective lens (10× magnification). A particle sheath "PSE-900A" (manufactured by Sysmex Corporation) is used as a sheath liquid. The dispersion liquid prepared in accordance with the above procedure is introduced into the flow-type particle image analyzer, and 3000 spherical resin particles are measured in a high power field (HPF) measurement mode and in a total count mode. With the binary threshold in the particle analysis being set to 85%, the range of the size of particles to be analyzed is specified. Thus, the number rate (percentage) and the average circularity of spherical resin particles that are of the size within the specified range are calculable.

Before conducting the measurement, automatic focus adjustment is performed by using a suspension obtained by suspending standard latex particles (Thermo Scientific (a trademark) Latex Microsphere Suspension 5200A manufactured by Thermo Fisher Scientific Inc.) in ion-exchanged water. Once the measurement is started, focus adjustment may be performed every two hours.

The flow-type particle image analyzer is provided with a calibration certificate issued by Sysmex Corporation, showing that the analyzer was calibrated by Sysmex Corporation. The measurement is conducted under the measurement and analysis conditions set forth at the receipt of the calibration certificate, except that the size of particles to be analyzed is limited to an equivalent circle diameter of 1.98 μm or larger and smaller than 39.69 μm.

<Method of Measuring Weight-Average Particle Size (D4) of Spherical Resin Particles>

The measurement is performed by using a particle-size-measuring instrument "Multisizer (a trademark) 3" (manufactured by Beckman Coulter, Inc.) and with an electrolytic solution that is an aqueous solution containing primary-standard sodium chloride by about 1%. Furthermore, about 0.5 ml of alkylbenzene sulfonate as a dispersant and about 5 mg of spherical resin particles (samples) to be measured are added to about 100 ml of the electrolytic solution, whereby the samples are suspended in the electrolytic solution. The electrolytic solution in which the samples are suspended is dispersed for about one minute by using an ultrasonic dispersion device. The volume and the number of samples are measured by using the above measuring instrument through an aperture of 100 μm, whereby the volume distribution and the number distribution are calculated. On the basis of the calculations, the weight-average particle size (D4) is calculated.

(Developing Device)

More specific exemplary embodiments of the developing device according to the present invention will now be described in detail with reference to the attached drawings. The dimensions, the materials, the shapes, the relative positions, and other factors of elements described in the following exemplary embodiments do not limit the scope of the present invention unless specifically described. FIG. 1 is a sectional view of a developing device according to a first exemplary embodiment of the present invention.

As illustrated in FIG. 1, the developing device includes a developing chamber 102 having an opening in a portion thereof facing an image carrying member 101. A toner container 104 that contains toner 103 is provided at the back of the developing chamber 102. The toner container 104 communicates with the developing chamber 102. An opening that allows the developing chamber 102 and the toner container 104 to communicate with each other is provided with a seal member 105 that prevents the toner 103 in the toner container 104 from flowing into the developing chamber 102. The seal member 105 is removable from the opening and is removed from the opening when the developing device starts to be used.

The seal member 105 prevents the toner 103 from unexpectedly flowing out of the developing device because of vibrations that may occur during, for example, the transportation of the developing device that is yet to be used, and thus prevents the user, the body of the developing device, and the body of an electrophotographic apparatus from being stained with the toner 103.

Figure 4:
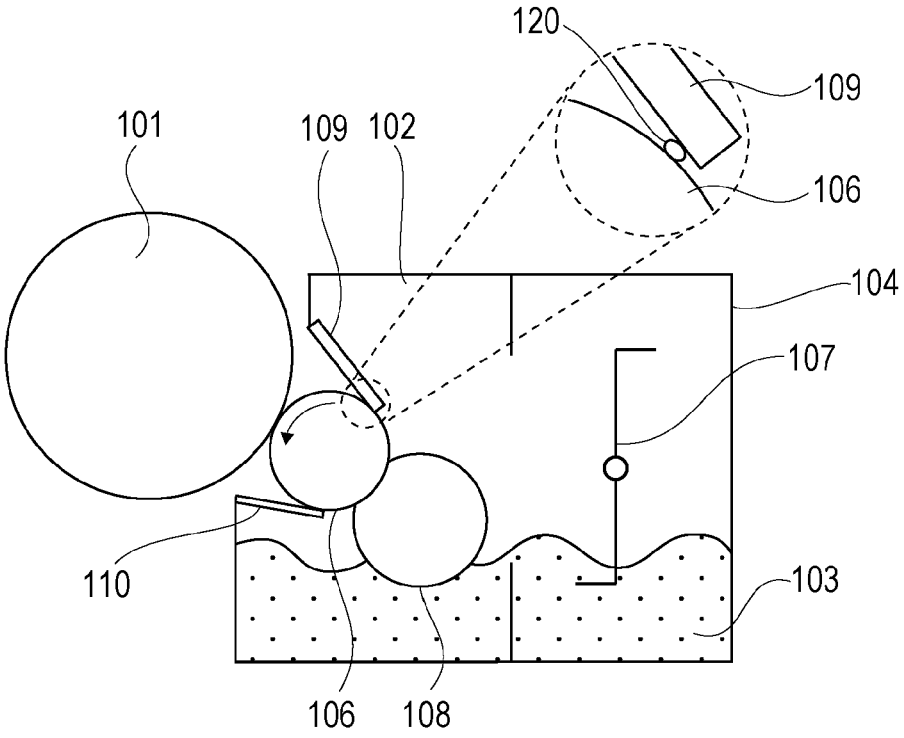
FIG. 4 is a schematic sectional view of the developing device according to the first exemplary embodiment of the present invention.

As illustrated in FIG. 4, in the developing device according to the first exemplary embodiment of the present invention, the opening that allows the developing chamber 102 and the toner container 104 to communicate with each other may be provided without the seal member 105.

The developing chamber 102 is provided with a rotatable developing roller 106, with a portion of the developing roller 106 being exposed to the outside. The developing roller 106 is provided against the image carrying member 101 in such a manner as to be pressed into the image carrying member 101 by a specific amount of bite.

The developing chamber 102 is further provided thereinside with a toner supplying member 108 that supplies the toner 103 conveyed from the toner container 104 by a conveying member 107 to the developing roller 106. A toner regulating member 109 that regulates the thickness of a layer of toner 103 carried by the developing roller 106 is provided on the upstream side with respect to a contact portion between the developing roller 106 and the image carrying member 101 in the direction of rotation of the developing roller 106. The toner regulating member 109 is in contact with the surface of the developing roller 106 and is attached to the developing chamber 102. In the first exemplary embodiment of the present invention, predetermined spherical resin particles 120 are provided at least in a contact portion between the developing roller 106 and the toner regulating member 109 so as to suppress the generation of a thrust memory.

A leakage preventing sheet 110 that prevents the leakage of the toner 103 from the lower side of the developing chamber 102 to the outside is provided on the downstream side with respect to the contact portion between the developing roller 106 and the image carrying member 101 in the direction of rotation of the developing roller 106.

Before development is performed, the seal member 105 is removed from the developing device. Thus, the toner container 104 and the developing chamber 102 form one continuous space, and it is only this time that the toner 103 in the toner container 104 is allowed to be fed into the developing chamber 102. The conveying member 107 conveys the toner 103 over a wall between the developing chamber 102 and the toner container 104 toward the toner supplying member 108, and the toner 103 is supplied to the developing roller 106 by the toner supplying member 108. While the developing roller 106 rotates in the direction illustrated by an arrow in FIG. 1, the toner 103 carried by the developing roller 106 is regulated to have a predetermined thickness by the toner regulating member 109 and is conveyed to a developing area that faces the image carrying member 101.

The spherical resin particles 120 are provided to the contact portion between the developing roller 106 and the toner regulating member 109 by any of the following three methods, for example. The method of providing the spherical resin particles 120 is not specifically limited as long as the spherical resin particles 120 are evenly provided over the surface of the developing roller 106 and the surface of the toner regulating member 109.

1. Spherical resin particles 120 are provided over the entirety of the surface of the developing roller 106 in advance, and the developing roller 106 in this state is attached to the developing device to which the toner regulating member 109 has already been attached.

2. Spherical resin particles 120 are provided to the contact portion between the toner regulating member 109 and the developing roller 106 in advance, and the toner regulating member 109 and the developing roller 106 in this state are attached to the developing device.

3. Spherical resin particles 120 are provided over the entirety of the surface of the toner supplying member 108, and the toner supplying member 108 in this state is attached to the developing device. Subsequently, the developing roller 106 and the toner regulating member 109 are attached to the developing device. Then, the developing device is activated, whereby the spherical resin particles 120 are supplied to the contact portion between the developing roller 106 and the toner regulating member 109 by the toner supplying member 108.

(Electrophotographic Process Cartridge and Electrophotographic Apparatus)

An electrophotographic apparatus according to a second exemplary embodiment of the present invention includes the following:

- an image carrying member that carries an electrostatic latent image;
- a charging device that performs primary charging on the image carrying member;
- an exposure device that forms the electrostatic latent image on the image carrying member that has undergone primary charging;
- a developing device that forms a toner image by developing the electrostatic latent image with toner;
- a transfer device that transfers the toner image to a transfer material; and
- a fixing device that fixes the toner image that has been transferred to the transfer material.

The developing device is the developing device according to the first exemplary embodiment of the present invention. The present invention also provides an electrophotographic process cartridge (hereinafter also simply referred to as process cartridge) that is attachable to and detachable from a body of an electrophotographic apparatus. The process cartridge includes the developing device according to the first exemplary embodiment of the present invention.

Figure 2:
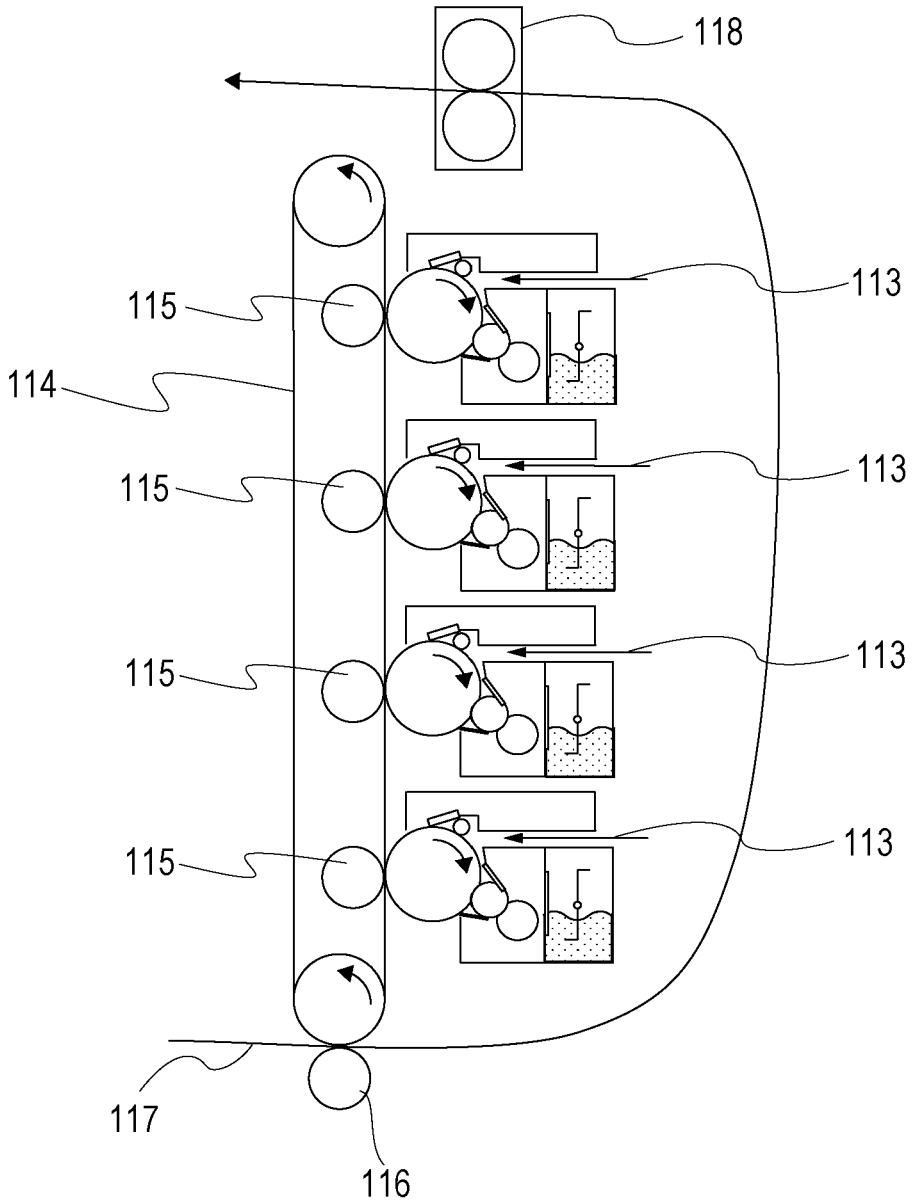
FIG. 2 is a schematic sectional view of an electrophotographic apparatus according to a second exemplary embodiment of the present invention.
Figure 3:
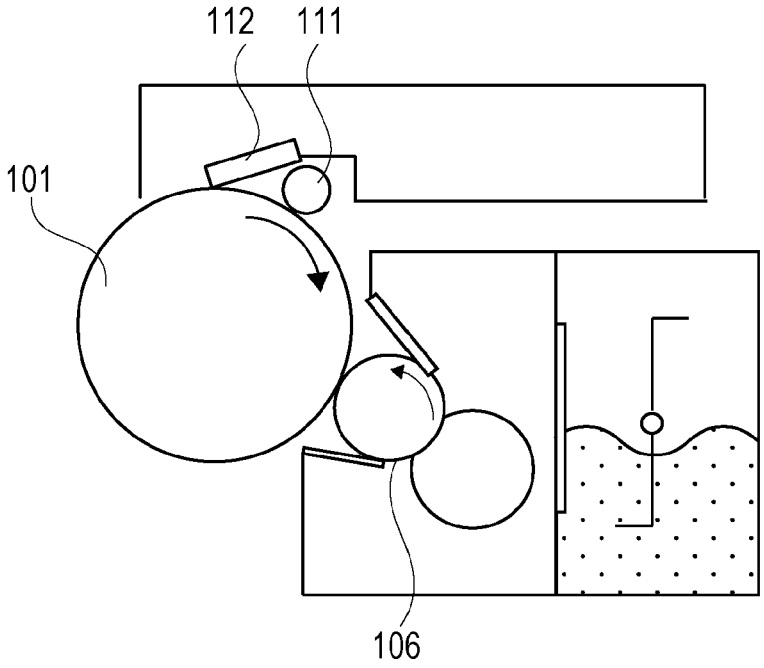
FIG. 3 is a schematic sectional view of an electrophotographic process cartridge included in the electrophotographic apparatus according to the second exemplary embodiment of the present invention.

FIG. 2 is a schematic sectional view of the electrophotographic apparatus according to the second exemplary embodiment of the present invention. FIG. 3 is an enlargement of one of process cartridges attached to the electrophotographic apparatus illustrated in FIG. 2. The process cartridge includes an image carrying member 101, a charging device including a charging member 111, a developing device including a developing roller 106, and a cleaning device including a cleaning member 112. The process cartridge is attachable to and detachable from the body of the electrophotographic apparatus illustrated in FIG. 2.

The image carrying member 101 is uniformly charged by the charging member 111 (primary charging). The charging member 111 is connected to a bias power source (not illustrated). The potential of the charged image carrying member 101 may be about −800 V or higher and about −400 V or lower. The charged image carrying member 101 is exposed to exposure light 113 for drawing an electrostatic latent image, whereby an electrostatic latent image is formed on the surface of the image carrying member 101. The exposure light 113 may be either light from a light-emitting diode (LED) or laser light. The potential in the portion of the surface of the image carrying member 101 that has been exposed to the exposure light 113 may be about −200 V or higher and about −100 V or lower.

Subsequently, toner that has been negatively charged by the developing roller 106 provided in the process cartridge that is detachably attached to the body of the electrophotographic apparatus is supplied (for development) to the electrostatic latent image, whereby a toner image is formed on the image carrying member 101. That is, the electrostatic latent image is converted into a visible image. During the development, a voltage of about −500 V or higher and about −300 V or lower may be applied to the developing roller 106 from a bias power source (not illustrated). The developing roller 106 and the image carrying member 101 that are in contact with each other may form a nip therebetween having a width of about 0.5 mm or larger and about 3 mm or smaller.

The toner image formed on the image carrying member 101 undergoes primary transfer to an intermediate transfer belt 114. A primary transfer member 115 is in contact with the back side of the intermediate transfer belt 114. A voltage of about +100 V or higher and about +1500 V or lower may be applied to the primary transfer member 115. With the application of the voltage, the toner image having a negative polarity undergoes primary transfer from the image carrying member 101 to the intermediate transfer belt 114. The primary transfer member 115 may have either a roller shape or a blade shape.

If the electrophotographic apparatus is a full-color image forming apparatus, the above steps of charging, exposure, development, and primary transfer are performed for each of colors of yellow, cyan, magenta, and black. To do so, the electrophotographic apparatus illustrated in FIG. 2 includes four process cartridges that contain toners having the respective colors. The process cartridges are detachably attached to the body of the electrophotographic apparatus. The above steps of charging, exposure, development, and primary transfer are performed sequentially with predetermined time lags. Thus, toner images in the four respective colors that in combination express a full color image are superposed on the intermediate transfer belt 114.

With the rotation of the intermediate transfer belt 114, the superposition of toner images on the intermediate transfer belt 114 is conveyed to a position that faces a secondary transfer member 116. In this step, a recording sheet as a transfer material is conveyed at a predetermined timing along a conveying route 117 into a nip between the intermediate transfer belt 114 and the secondary transfer member 116. Then, a secondary transfer bias is applied to the secondary transfer member 116, whereby the superposition of toner images on the intermediate transfer belt 114 is transferred to the recording sheet.

The bias voltage applied to the secondary transfer member 116 in the above step may be about +1000 V or higher and about +4000 V or lower. The recording sheet having the superposition of toner images transferred thereto by the secondary transfer member 116 is then conveyed to a fixing device 118, where the superposition of toner images on the recording sheet is fused and is fixed to the recording sheet. Subsequently, the recording sheet is discharged to the outside of the electrophotographic apparatus. Thus, a printing operation ends.

Portions of the toner images remaining on the image carrying members 101 without being transferred from the image carrying members 101 to the intermediate transfer belt 114 are scraped from the image carrying members 101 by the respective cleaning members 112 that clean the surfaces of the image carrying members 101. Thus, the surfaces of the image carrying members 101 are cleaned.

EXAMPLES

The present invention will now be described in further details with working examples and comparative examples. The technical scope of the present invention is not limited to the following examples.

<Spherical Resin Particles>

Spherical resin particles used in working examples and comparative examples are summarized in Table 1. Spherical Resin Particles 1 to 4 were used in Working Examples 1 to 4, respectively. Spherical Resin Particles 5 to 9 were used in Comparative Examples 1 to 5, respectively. The weight-average particle size and the average circularity were measured by the above-described methods.

TABLE 1

| Spherical Resin Particle | Base material | Product | Weight-average particle size (μm) | Average Circularity |
|---|---|---|---|---|
| 1 | Urethane resin | "UCN5070D Clear" of Dainichiseika Color & Chemicals Mfg. Co., Ltd. | 7.2 | 0.978 |
| 2 | Urethane resin | "UCN5150D Clear" of Dainichiseika Color & Chemicals Mfg. Co., Ltd.* | 14.9 | 0.971 |
| 3 | Urethane resin | "UCN5150D Clear" of Dainichiseika Color & Chemicals Mfg. Co., Ltd.* | 14.7 | 0.962 |
| 4 | Urethane resin | "JT-600T" of Negami Chemical Industrial Co., Ltd. | 10.2 | 0.981 |
| 5 | Urethane resin | "U-400T" of Negami Chemical Industrial Co., Ltd. | 14.1 | 0.980 |
| 6 | Urethane resin | "CE-400T" of Negami Chemical Industrial Co., Ltd. | 14.8 | 0.981 |
| 7 | Silicone resin | "Tospearl (a trademark) 120" of Momentive Performance Materials Inc. | 2.1 | 0.989 |
| 8 | Styrene resin | "SBX-6" of Sekisui Plastics Co., Ltd. | 11.9 | 0.985 |
| 9 | Acrylic resin | "MX-1500" of Soken Chemical Engineering Co., Ltd. | 15.1 | 0.984 |

*Spherical Resin Particles 2 and 3 were obtained by performing the following processes, respectively, on "UCN5150D Clear."

(Spherical Resin Particle 2)

First, 100 parts by mass of "UCN5150D Clear" manufactured by Dainichiseika Color & Chemicals Mfg. Co., Ltd. was dipped into 1000 parts by mass of a 50%-by-mass methyl-ethyl-ketone solution containing 4,4'-diphenylmethane diisocyanate (manufactured by Sigma-Aldrich Co. LLC.) for 10 minutes. Subsequently, resulting spherical resin particles were cleaned with ethanol and were dried at room temperature for 48 hours. Then, the spherical resin particles were baked in an oven at 80° C. for four hours. Thus, Spherical Resin Particle 2 was obtained.

(Spherical Resin Particle 3)

First, 100 parts by mass of "UCN5150D Clear" manufactured by Dainichiseika Color & Chemicals Mfg. Co., Ltd. was dipped into 1000 parts by mass of a 50%-by-mass methyl-ethyl-ketone solution containing 4,4'-diphenylmethane diisocyanate (manufactured by Sigma-Aldrich Co. LLC.) for 60 minutes. Subsequently, resulting spherical resin particles were cleaned with ethanol and were dried at room temperature for 48 hours. Then, the spherical resin particles were baked in an oven at 80° C. for four hours. Thus, Spherical Resin Particle 3 was obtained.

<Manufacturing Developing Roller>

(Forming Conductive Elastic Layer 1)

A semiconductive composite 1 was prepared by mixing substances given in Table 2 at room temperature by using an agitator.

TABLE 2

| | | |
|---|---|---|
| Polysiloxane having vinyl group at terminal | "DMS-V42" of AZmax. Co | 100 parts by mass |

TABLE 2-continued

| | | |
|---|---|---|
| Hydrosilyl cross-linker | "HMS-151" of AZmax. Co | 5.4 parts by mass |
| Platinum catalyst | "SIP6831-3" of AZmax. Co | 0.15 parts by mass |
| Carbon black | "#970" of Mitsubishi Chemical Corporation | 8.0 parts by mass |

Subsequently, a primer ("DY35-051" manufactured by Dow Corning Toray Co., Ltd.) was applied to a metal core made of SUS304 (a kind of stainless steel according to a Japanese Industrial Standard) and having a diameter of 6 mm and a length of 264 mm. The metal core was baked at 150° C. for 30 minutes and was placed into a mold. Then, the semiconductive composite 1 was injected into a cavity of the mold. Subsequently, the mold was heated at 150° C. for 15 minutes and was released. Then, the resultant was heated at 200° C. for two hours, whereby a curing reaction was complete. Thus, a conductive elastic layer 1 having a diameter of 11.5 mm was formed.

(Preparing Paint 1 for Conductive Surface Layer)

Substances given in Table 3 were put into a quadruple-neck separable flask provided with an agitator, a cooler, a thermometer, and a nitrogen introduction tube, and the substances were made to react one another in a nitrogen atmosphere at 80° C. for five hours while being agitated. Subsequently, the solvent was removed. Thus, urethane prepolymer 1 having a carboxyl group in its molecular structure was obtained.

TABLE 3

| | | |
|---|---|---|
| Polyol | "PTG1000" of Hodogaya Chemical Co., Ltd. | 250 parts by mass |
| Dimethylol propionic acid | Manufactured by Sigma-Aldrich Co. LLC. | 20 parts by mass |
| 4,4'-diphenyl-methane diisocyanate | Manufactured by Sigma-Aldrich Co. LLC. | 100 parts by mass |
| Methyl ethyl ketone as solvent | — | 1000 parts by mass |

Subsequently, substances given in Table 4 were stirred and dispersed with a ball mill, whereby a paint 1 for a conductive surface layer was prepared.

TABLE 4

| | | |
|---|---|---|
| Urethane prepolymer 1 | | 150 parts by mass |
| Polyol | "NIPPOLLAN (a registered trademark) 4010" of Nippon Polyurethane Industry Co., Ltd. | 100 parts by mass |
| Carbon black | "#2700" of Mitsubishi Chemical Corporation | 30 parts by mass |
| Acrylic resin particles | "MX-1000" of Soken Chemical Engineering Co., Ltd. | 30 parts by mass |

Methyl ethyl ketone was added to the paint 1 for a conductive surface layer prepared as described above, whereby the paint 1 for conductive surface layer was adjusted to have a solid content of 28%. Then, the paint 1 was applied over the conductive elastic layer 1, molded as described above, by dipping. Subsequently, the resultant was dried in an oven at 80° C. for 15 minutes and was cured in an oven at 140° C. for four hours. Thus, a developing roller was obtained. The thickness of the surface layer was 10.2 μm.

Subsequently, 100 mg of the spherical resin particles were evenly provided over the entirety of the above developing roller in the longitudinal direction of the developing roller. Meanwhile, a developing roller attached to a process cartridge for cyan included in a color laser printer (HP Laser Jet Pro 400 M451dn manufactured by Hewlett-Packard Development Company, L.P.) was detached from the cartridge, and a toner regulating member was cleaned by blowing air thereto. Subsequently, the above developing roller having the spherical resin particles thereon was attached to the cartridge. Thus, a cartridge including a developing device in which the spherical resin particles were provided in the contact portion between the developing roller and the toner regulating member was obtained.

A vibration test described below was conducted on the above cartridge. After conducting the vibration test, the process cartridge was left in an environment that is at a temperature of 23° C. and with a humidity of 55% for 24 hours. Then, a seal member that separates a developing chamber and a toner container included in the developing device of the cartridge was removed. Subsequently, the process cartridge was attached to the above color laser printer. Then, a cyan halftone image was printed on each of 100 A4-size recording sheets (color-laser-copier (CLC) paper manufactured by Canon Kabusiki Kaisha and having a basis weight of 81.4 g/m$^2$). The printing was continuously performed in an environment that is at a temperature of 23° C. and with a humidity of 55%.

The resulting 100 halftone images were visually observed, and the occurrence of banding attributed to any thrust memory was graded on the basis of criteria summarized in Table 5 below.

TABLE 5

| Grade | Criteria |
|---|---|
| A | No banding occurred in the halftone images. |
| B | Although thin banding occurred in the first one of the halftone images, no banding occurred in the second and subsequent halftone images. |
| C | Although banding occurred in the first to ninth halftone images, banding became thinner in the tenth and subsequent halftone images and substantially no banding occurred in the twentieth and subsequent halftone images. |
| D | Banding occurred even in the hundredth halftone image. |

<Cartridge Vibration Test>

On the basis of a vibration test according to Japanese Industrial Standard No. JIS-Z0232, a cartridge vibration test was conducted on the following conditions: a vibration frequency of 50 Hz, a sweep time of 5 minutes (one reciprocation), a sine-wave acceleration of 1G, ten times of vibration application in each of the X, Y, and Z directions, and a vibration time of one hour (twelve reciprocations) in each of the X, Y, and Z directions.

TABLE 6

| | Spherical Resin Particle No. | Martens hardness (N/mm$^2$) | Restoring elastic power (%) | Banding grade |
|---|---|---|---|---|
| Working Example 1 | 1 | 2.8 | 78 | A |
| Working Example 2 | 2 | 23 | 75 | A |
| Working Example 3 | 3 | 45 | 72 | A |
| Working Example 4 | 4 | 0.5 | 70 | A |
| Comparative Example 1 | 5 | 35 | 30 | C |
| Comparative Example 2 | 6 | 11 | 33 | C |
| Comparative Example 3 | 7 | 52 | 89 | C |
| Comparative Example 4 | 8 | 128 | 65 | D |
| Comparative Example 5 | 9 | 94 | 51 | D |
| Comparative Example 6 | N/A | — | — | D |

Table 6 summarizes the Martens hardness, the restoring elastic power, and the banding grade of each of Spherical Resin Particles 1 to 9.

In each of Working Examples 1 to 4, spherical resin particles that meet the criteria of the Martens hardness and the restoring elastic power according to the present invention were provided in the contact portion between the developing roller and the toner regulating member. Therefore, in the developing device, the occurrence of banding attributed to a thrust memory was very effectively suppressed.

These results are presumed to have been obtained with a combination of Factors (1) to (3) below.

(1) Flexible spherical resin particles each having a Martens hardness within a specific range were able to roll under the vibrations while being deformed into oval shapes.

(2) The application of any physical stress to the developing roller was suppressed.

(3) The spherical resin particles were each able to retain the spherical shape with a high restoring elastic power even under the repeated vibrations, and the occurrence of uneven distribution of the particles attributed to insufficient rolling of the particles was suppressed.

In each of Working Examples 1 to 4, the spherical resin particles according to the present invention were present in the contact portion between the developing roller and the toner regulating member. The characteristics of these particles contributed to the technical realization of the advantageous effect of the present invention.

In contrast, in each of the developing devices according to Comparative Examples 1 and 2, the restoring elastic power of the spherical resin particles provided between the developing roller and the toner regulating member was small. Therefore, under the repeated vibrations, the spherical resin particles were distorted and were unevenly distributed. Consequently, a thrust memory was generated on the developing roller, and banding attributed to the thrust memory occurred in the halftone images.

In the developing device according to Comparative Example 3, the spherical resin particles provided between the developing roller and the toner regulating member had a high Martens hardness. Therefore, a thrust memory probably attributed to a physical stress applied to the developing roller was generated. Consequently, banding attributed to the thrust memory occurred in the halftone images. However, the thrust memory was gradually eliminated as image formation was continued, and substantially no banding occurred in the twentieth and subsequent halftone images.

In each of Comparative Examples 4 and 5, the Martens hardness was high, and the restoring elastic power was small. Therefore, the spherical resin particles were unevenly distributed, and a physical stress was applied to the developing roller. Consequently, a thrust memory was generated on the developing roller, and banding attributed to the thrust memory occurred. The thrust memory was hardly eliminated even after the continued image formation. Banding occurred even in the hundredth halftone image.

In Comparative Example 6, no spherical resin particles were provided. Therefore, a thrust memory was generated on the developing roller, and banding attributed to the thrust memory occurred. The thrust memory was hardly eliminated even after the continued image formation.

Banding Occurred Even in the Hundredth Halftone Image.

According to the present invention, even if the developing device is stored while being subject to vibration attributed to long-time transportation, an electrostatic memory does not tend to be generated on the developing roller. Therefore, the developing device does not tend to cause banding in halftone images. Furthermore, according to the present invention, a process cartridge and an electrophotographic apparatus that are capable of forming high-quality electrophotographic images are provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-135659 filed Jun. 27, 2013, which is hereby incorporated by reference herein in its entirety.

What is claimed is:

1. A developing device comprising:

a developing chamber provided with a developing roller that conveys toner to a developing area, and a toner regulating member that is in contact with a surface of the developing roller; and a toner container that contains the toner, wherein an opening that allows the developing chamber and the toner container to communicate with each other is closed by a seal member that prevents the toner in the toner container from flowing into the developing chamber, and the seal member is removable from the opening, wherein spherical resin particles are provided as powder on the surface of the developing roller and/or the toner regulating member at least in a contact portion between the developing roller and the toner regulating member, and wherein a Martens hardness of the spherical resin particles is 0.5 $N/mm^2$ or higher and 45 $N/mm^2$ or lower, and a restoring elastic power of the spherical resin particles is 70% or higher.

2. The developing device according to claim 1, wherein a base material of the spherical resin particles is urethane resin.

3. The developing device according to claim 1, wherein an average circularity of the spherical resin particles is 0.96 or higher.

4. The developing device according to claim 1, wherein a weight-average particle size of the spherical resin particles is 1 μm or larger and 50 μm or smaller.

5. A process cartridge that is attachable to and detachable from a body of an electrophotographic apparatus, the process cartridge comprising:

an image carrying member that carries an electrostatic latent image; and a developing device that forms a toner image by developing the electrostatic latent image with toner, wherein the developing device is the developing device according to claim 1.

6. An electrophotographic apparatus comprising:

an image carrying member that carries an electrostatic latent image;

a charging device that performs primary charging on the image carrying member;

an exposure device that forms the electrostatic latent image on the image carrying member that has undergone primary charging;

a developing device that forms a toner image by developing the electrostatic latent image with toner; and a transfer device that transfers the toner image to a transfer material, wherein the developing device is the developing device according to claim 1.

7. A developing device comprising:

a developing chamber provided with a developing roller that conveys toner to a developing area, and a toner regulating member that is in contact with a surface of the developing roller; and a toner container that contains the toner, wherein spherical resin particles are provided as powder on the surface of the developing roller and/or the toner regulating member at least in a contact portion between the developing roller and the toner regulating member, and wherein a Martens hardness of the spherical resin particles is 0.5 $N/mm^2$ or higher and 45 $N/mm^2$ or lower, and a restoring elastic power of the spherical resin particles is 70% or higher.

* * * * *